United States Patent [19]

Hackman et al.

[11] 4,448,569

[45] May 15, 1984

[54] LIFT SLING EMPLACEMENT DEVICE

[75] Inventors: Donald J. Hackman, Columbus; Don W. Caudy, Dublin, both of Ohio; Robert L. Wernli, San Diego, Calif.; Carl S. Albro, Worthington, Ohio

[73] Assignee: The United States of America as represented by the Secretary of the Navy, Washington, D.C.

[21] Appl. No.: 276,416

[22] Filed: Jun. 22, 1981

[51] Int. Cl.[3] ..... B63C 11/52

[52] U.S. Cl. ..... 405/190; 114/55; 294/66 R; 405/173

[58] Field of Search ..... 405/163, 173, 185, 190, 405/191, 303; 114/50, 51, 55; 294/66 R, 66 A

[56] References Cited

U.S. PATENT DOCUMENTS

| | | | |
|---|---|---|---|
| 148,715 | 3/1874 | Knapp | 114/55 X |
| 748,484 | 12/1903 | Cummings et al. | 114/55 |
| 3,626,703 | 12/1971 | Richburg | 405/191 |
| 3,986,745 | 10/1976 | Langguth | 294/66 R |

*Primary Examiner*—David H. Corbin

*Attorney, Agent, or Firm*—R. F. Beers; E. F. Johnston; Harvey Fendelman

[57] ABSTRACT

An apparatus is disclosed which is employable by a remotely controlled underwater work system to emplace a lift sling beneath an object resting on mud, sand or the like. The apparatus includes a hollow tube and a guide having rollers through which the tube may be passed. The rearward end of the tube is attached to a hose through which water under pressure is directed into the tube. The forward end of the tube is provided with a nozzle so that jets of water issue from it with selected strength and in a selected configuration. A sling or strap is connected at one end to the nozzle end of the tube and at its other end to the guide. A rope or cord is also attached to the guide portion of the apparatus. A mechanical grabber or other mechanism holds the guide in a fixed position with respect to the object to be retrieved while a manipulator arm of the system pushes the tube through the guide and beneath the object to be salvaged. The water jetting from the nozzle of the tube clears a path for the tube as it passes beneath the object and pulls the sling or strap under the object. When the tube reaches the far side of the object, the end of the lifting sling is accessible. The rope is transported across the top of the object and is pulled through the far end of the lifting sling to cinch the lifting sling around the object. A latch hook is attached to the end of the rope and may then be hooked onto a lifting device to recover the object.

18 Claims, 9 Drawing Figures

LIFT SLING EMPLACEMENT DEVICE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates generally to the field of retrieval of sunken objects and also to the field of securing and lifting devices. Attachment of lifting lines to sunken objects using remote controlled manipulators is one of the most difficult tasks involved in recovering objects from the deep ocean.

Attachment methods used in the past have included the use of power velocity studs, welding, various rigging techniques, toggles, clamps, and drilling, tapping and bolting. Each technique has its advantages and limitations. Some objects such as aircraft fuselages do not readily lend themselves to attaching lift points. It is desirable to rig this type of object for lift by rigging slings or nets around it. This is often a very difficult task if the object is partially buried in mud or sand.

SUMMARY OF THE INVENTION

The present invention was developed to assist in inserting slings under partially buried objects.

The present invention is particularly useful for inserting a lift sling under objects resting in sand or mud. Features of the sling include a lightweight jetting tube supported and guided by a special sling holder assembly. The jetting tube is in the form of an arc having a predetermined radius and is advanced using a mechanical manipulator such as the Navy Work Systems Package Manipulator which essentially is a remotely controlled mechanical manipulator device. The sling is attached to the nozzle end of the jetting tube and is pulled under the object as the jetting tube is advanced. Jetting water is provided by a vehicle mounted pump through a hose with a manipulator operable quick disconnect fitting. Once the sling has been drawn under the object to be recovered, a rope attached at one of its ends to the sling holder assembly can be looped over the object and through an eye in the opposite end of the lift sling to cinch or choke up the sling around the object. One or more of the apparatuses of the present invention may be utilized to secure and recover an object.

OBJECTS OF THE INVENTION

Accordingly, it is the primary object of the present invention to disclose a novel lift sling mechanism particularly useful for recovering objects resting in sand or mud through the use of remotely controlled vehicles.

It is another object of the present invention to disclose a lifting device particularly useful for lifting objects which may not be drilled, clamped or welded.

Other objects and many of the attendant advantages of this invention will be readily appreciated as the same becomes better understood by reference to the following detailed description when considered in connection with the accompanying drawings.

DESCRIPTION OF THE PREFERRED EMBODIMENT

Figure 1:
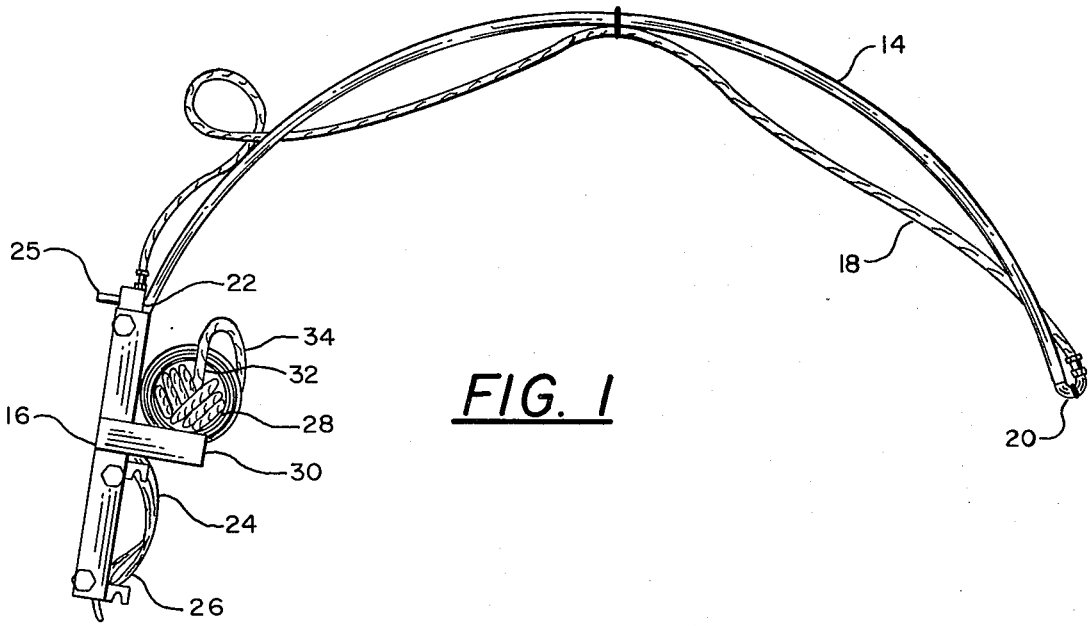
FIG. 1 is a side view of the grabber side of the present invention.

Referring now to FIGS. 1–8 the lift sling emplacement device 12 of the present invention will be described. As seen in FIGS. 1–3, 4*a* and 4*b*, the fully assembled lift sling emplacement device is comprised of a curved steel jetting tube 14 which is supported by and guided by support frame 16. In its preferred embodiment, the curved jetting tube is made of steel and is rolled into a ten foot diameter semicircle. It is to be understood, however, that other materials may be utilized to form the jetting tube 14 and that different lengths and radii from those described above may be utilized. The jetting tube 14 is supplied by water, other fluid, air or the like by hose 18 which is connected to the jetting tube 14 via coupling 20 at one end of the jetting tube 14. The other end of the hose 18 is secured to the support frame 16 by coupling member 22. Coupling member 22 has connected to it a male quick disconnect fitting 25 for attachment to a source of water or other fluid or high pressure air. As seen in FIG. 1 the lift sling emplacement device 12 is illustrated in its predepolyment configuration. In the storage position the lift sling emplacement device 12 includes a length of sling or strap 24 which has a loop 26 at one end thereof which is attached to the nozzle end of the jetting tube 14. The strap is coiled around hollow drum 28 which is welded to the mechanical grabber plate member 30 of the support frame 16. The end of the strap 24 opposite the loop end 26 is also terminated in a loop similar to loop 26 which extends around the drum 28 in slideable engagement therewith. Welded to the drum 28 is a rope guide or eyelet 32 which extends through the interior hollow portion of the drum 28 and secures the rope or cord 34 as by crimping. The remainder of the rope 34 is stored within the interior of the drum member 28.

Figure 2:
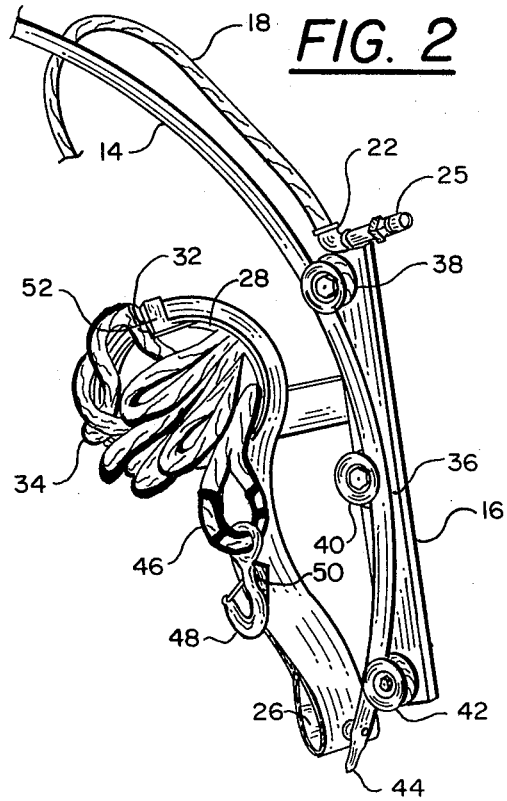
FIG. 2 is a perspective view of the roller side of a portion of the present invention.

Referring now to FIG. 2 there is illustrated in perspective view a portion of the lift sling emplacement device 12 of the present invention, illustrating the roller side of the support frame 16. As seen in FIG. 2 the support frame 16 includes a support bracket 36 to which are rotatably attached the support and guide rollers 38, 40, and 42. It is noted that the guide roller 40 is offset from the line formed by the guide rollers 38 and 42 such that the jetting tube 14 contacts the guide rollers 38 and 42 on one side and contacts the guide roller 40 on the opposite side. In this manner the jetting tube 14 is secured in position and at the same time may be passed through the guide rollers 38, 40 and 42 as will be described below. Also illustrated in FIG. 2 is the nozzle end 44 of the jetting tube 14. Further, it is seen in FIG. 2 that the rope or choker cable 34 terminates in a loop end 46 to which snap hook 48 is connected. Snap hook 48 is also fitted with a mechanical grabber plate 50 to enable the snap hook 48 to be manipulated by a mechanical grabber or robot type arm. In order to keep the snap hook 48 in place during storage of the lift sling emplacement device 12, a snap hook support hander 52 is welded to the rope guide-eyelet crimp device 32.

Figure 3:
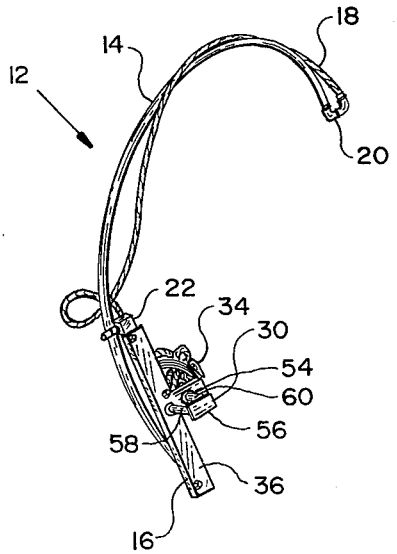
FIG. 3 is a perspective view of the grabber side of the present invention.
Figure 4B:
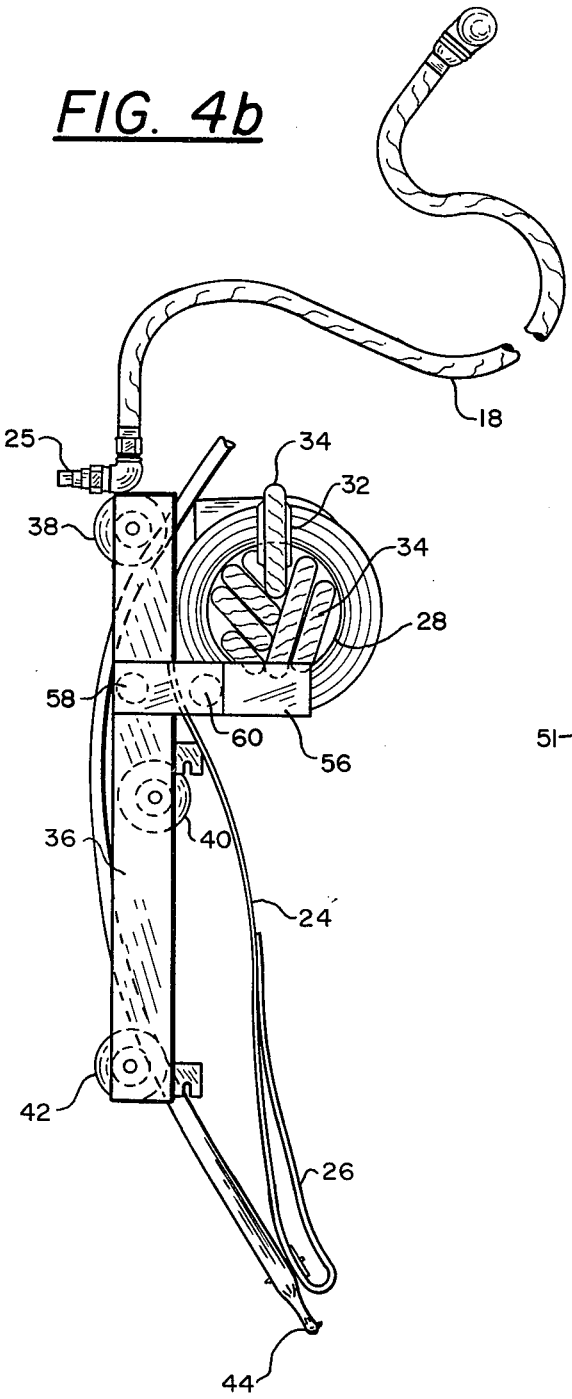
FIG. 4*b* is a side view of the present invention.
Figure 4A:
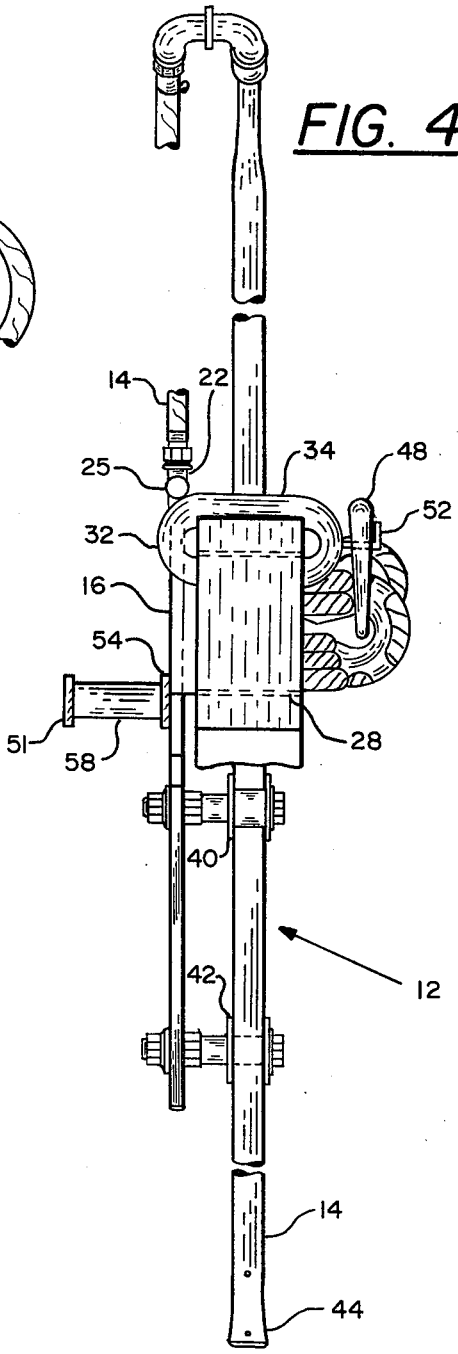
FIG. 4*a* is a top view of the present invention.

Referring now to FIG. 3 there is illustrated in perspecitve view the grabber side of the lift sling emplacement device 12 of the present invention. As seen in FIG. 3, welded to support bracket 36 is the mechanical grabber plate member 30. The mechanical grabber member 30 includes an interior plate 54 to which the drum member 28 is secured as by welding. An exterior plate 56 is provided and is connected to the interior plate 54 by connecting bars 58 and 60. By this member 30, therefore, various surfaces are provided by which a mechanical grabber or robot type device may engage the lift sling emplacement device 12.

Figure 5:
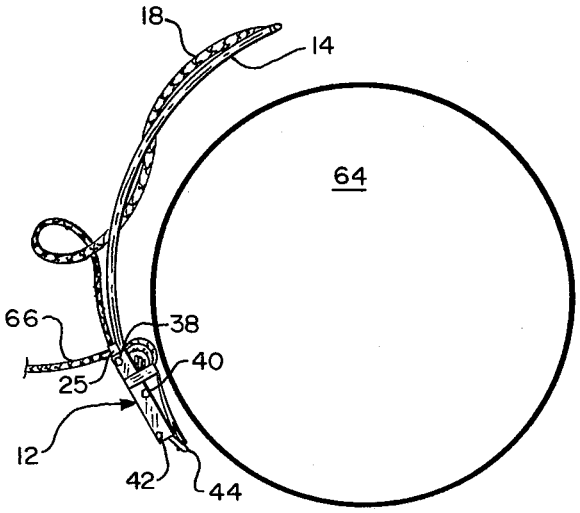
FIGS. 5, 6, 7 and 8 are schematic illustrations of the apparatus of of the present invention during various phases of its installation.
Figure 6:
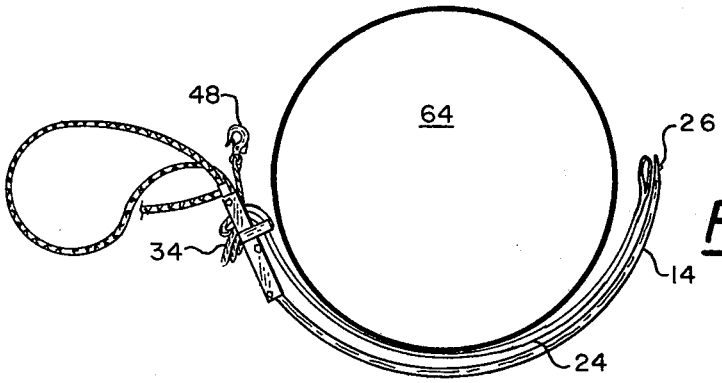
Figure 7:
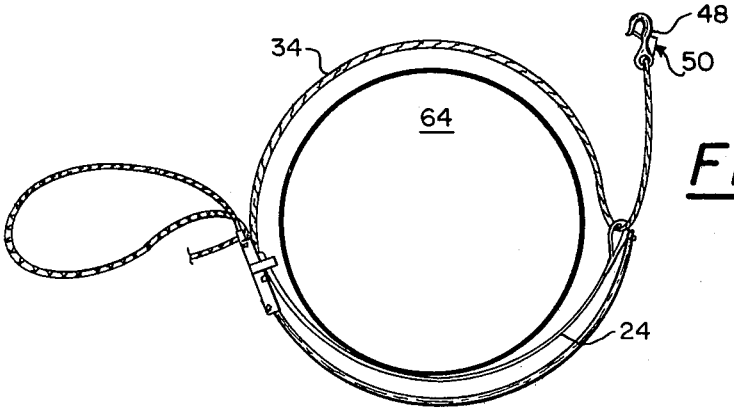
Figure 8:
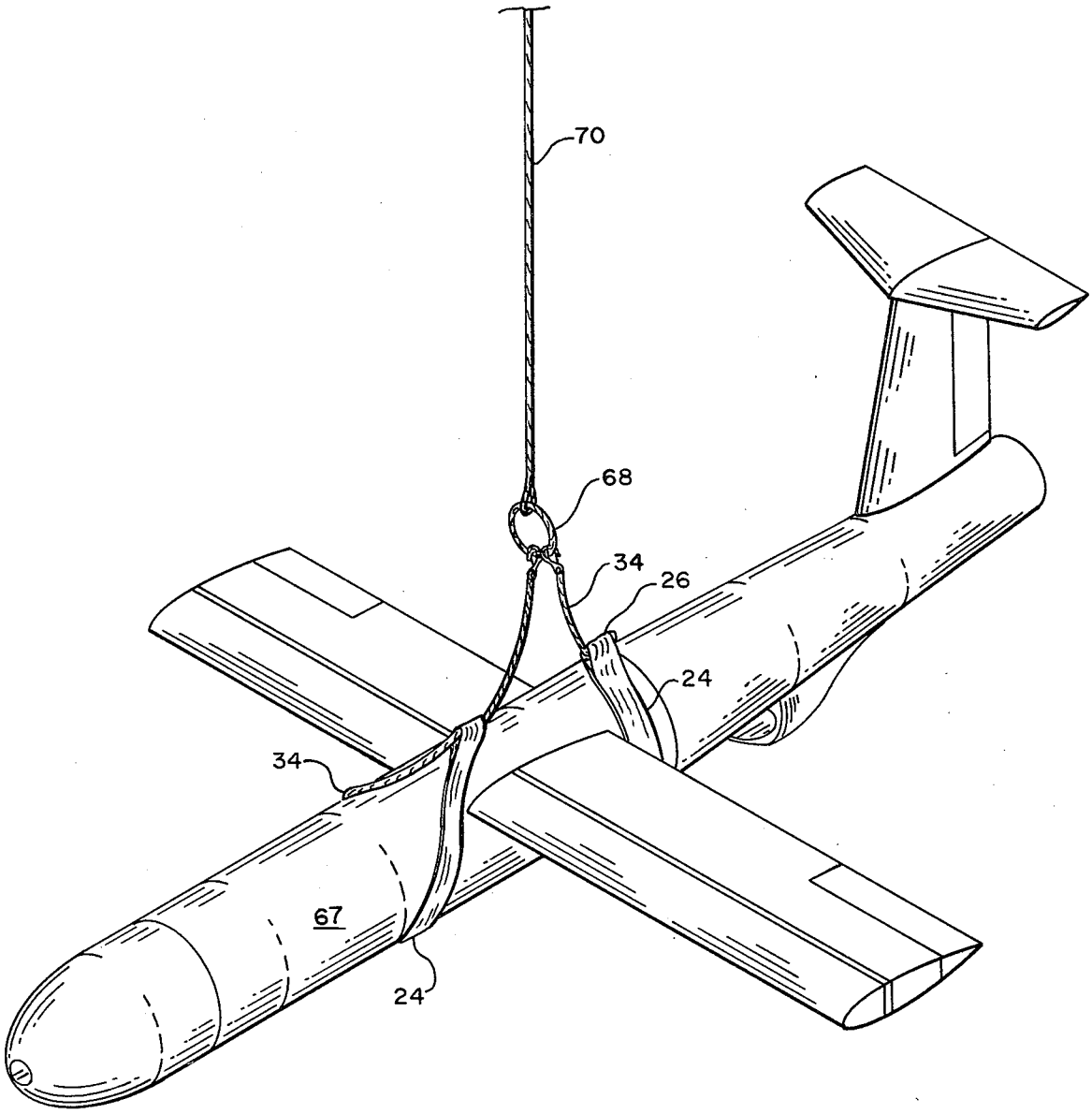

Referring to the schematic illustrations of FIGS. 5, 6, 7 and 8, the operation of the device will now be described. As illustrated in FIG. 5 the lift sling emplacement device 12 of the present invention is shown adjacent the fuselage of an aircraft 64 which is to be salvaged. The fuselage 64 is illustrated as resting on the sand or mud buttom of the ocean by way of example. The nozzle end 44 of the lift sling emplacement device 12 is positioned between the fuselage 64 and the ocean bottom. A water hose 66 is connected to the quick disconnect fitting 25 to provide jetting water to the device 12. Jetting water thereby passes through the hose 18, the jetting tube 14 and out the spray nozzle 44 in order to clear the path for the jetting tube 14 to be past beneath the fuselage or objects 64. In the position illustrated in FIG. 6 the jetting tube 14 has been advanced under the fuselage 64 and has drawn along with it the lift sling 24 such that the sloop end 26 of the lift sling 24 is generally on the side of the fuselage opposite the support bracket 16. It should be noted at this point that the support bracket 16 in the preferred embodiment is secured in its position by means of a mechanical grabber or robot type device which grasps the device 12 by means of the grabber member 30 and that the jetting tube 14 may be advanced through the guideframe 16 by means of a mechanical manipulator such as the Navy Work Systems Package Manipulator. In the position illustrated in FIG. 7, the choker cable 34 has drawn over the fuselage 64 and passed through the loop 26 of the sling 24. By securing to grabber plate 50, the snap hook 48 may be pulled to cinch up the choker cable 34 such that the sling 24 and choker cable 34 are taut around the fuselage. Referring to FIG. 8 there is illustrated in schematic diagram the utilization of two lift sling emplacement devices 12 of the present invention to secure the fuselage of an aircraft 67. As illustrated in FIG. 8 the lift slings 24 have been drawn under the fuselage of the aircraft 67 and the choker cables 34 of each of the two devices 12 utilized in FIG. 8 have been drawn through the loop ends 26 of the slings 24. Hook members 48 have been attached to a ring 68 which in turn is secured to a lift line 70. As can be seen in FIG. 8 utilization of two lift sling devices 12 at forward and aft portions on the fuselage of an aircraft can provide balance to ensure that the aircraft or other object to be retrieved does not tilt during recovery.

Obviously, many other modifications and variations of the present invention are possible in the light of the above teachings. It is therefore to be understood that within the scope of the appended claims the invention may be practiced otherwise than as specifically described.

What is claimed is:

1. A device for enabling the lifting of an object comprising:

a support frame;

an elongate tubular member in slideable engagement with said support frame, said tubular member having a first end and a second end;

a hose having a first end connected to said tubular member first end and having a second end secured to said support frame;

a strap having a first end connected to said tubular member second end and having a second end secured to said support frame; and a cord having first and second ends, said cord first end being secured to said support frame.

2. The device of claim 1 wherein said support frame comprises:

a support bracket;

a plurality of rollers affixed to said support bracket for said slideable engagement with said tubular member; and a drum member secured to said support bracket.

3. The device of claim 2 wherein said drum member further comprises:

means for securing said cord to said drum member.

4. The device of claim 3 wherein said securing means comprises an eyelet.

5. The device of claim 3 wherein:

said device has a storage position and a utilization position;

said drum member has an interior cavity and said cord is stored in said interior cavity in said storage position and said strap is wound around said drum in said storage position.

6. The device of claim 5 wherein said strap has a loop at said strap second end and wherein said strap loop is looped around said drum member.

7. The device of claim 6 further comprising:

a snap hook connected to said cord second end.

8. The device of claim 7 further comprising:

a snap hook support hanger for receiving said snap hook when said device is in said storage position.

9. The device of claims 1, 2, 3, 4, 5, 6, 7 or 8 wherein said strap first end terminates in a loop.

10. The device of claim 9 further comprising:

a grabber plate affixed to said support frame for enabling a mechanical grabber to hold said support frame.

11. The device of claim 7 further comprising:

a grabber plate connected to said snap hook for enabling holding of said snap hook by a mechanical grabber.

12. The device of claim 1 further comprising:

a quick disconnect fitting connected to said hose second end.

13. The device of claim 1 wherein:

said elongate tubular member terminates in a fluid spray nozzle.

14. The device of claims 1, 2, 3, 4, 5, 6, 7, or 8 wherein said elongate tubular member is curvilinear.

15. The device of claim 1 wherein:

said tubular member is substantially longer than said support frame.

16. The device of claim 5 wherein:

said strap first end terminates in a loop; and in said utilization position, said cord second end extends through said strap first end loop.

17. A device for enabling the lifting of an object comprising:

a support frame;

an elongate tubular member in slidable engagement with said support frame for encompassing at least a portion of said object, said tubular member having a first end and a second end;

a hose having a first end connected to said tubular member first end and having a second end secured to said support frame for transmitting fluid into said tubular member;

a strap having a first end connected to said tubular member second end and having a second end secured to said support frame; and a cord having first and second ends, said cord first end being secured to said support frame;

whereby as said elongate tubular member is moved so as to partially encompass said object, said strap is drawn therewith so as to partially encompass said object and whereby said cord may be drawn so as to partially encompass said object and so as to be coupled with said strap so as to cooperate with said strap to completely encompass said object and enable lifting thereof by applying a lifting force to said cord.

18. The device of claim 17 wherein:

said elongate tubular member is substantially longer than said support frame.

* * * * *